US006796812B2

(12) United States Patent
Reicharz

(10) Patent No.: US 6,796,812 B2
(45) Date of Patent: Sep. 28, 2004

(54) MULTIPOLE ELECTRICAL CONNECTOR

(75) Inventor: Armin Reicharz, Vich (CH)

(73) Assignee: Fischer Connectors Holding S.A., Apples (CH)

( * ) Notice: Subject to any disclaimer, the term of this patent is extended or adjusted under 35 U.S.C. 154(b) by 0 days.

(21) Appl. No.: 10/469,156

(22) PCT Filed: Feb. 27, 2002

(86) PCT No.: PCT/CH02/00117

§ 371 (c)(1),
(2), (4) Date: Aug. 27, 2003

(87) PCT Pub. No.: WO02/073751

PCT Pub. Date: Sep. 19, 2002

(65) Prior Publication Data

US 2004/0077223 A1 Apr. 22, 2004

(30) Foreign Application Priority Data

Mar. 12, 2001 (CH) ..... 45101

(51) Int. Cl.[7] ..... H01R 4/66; H01R 13/648
(52) U.S. Cl. ..... 439/108; 439/676
(58) Field of Search ..... 439/108, 676, 439/941, 92

(56) References Cited

U.S. PATENT DOCUMENTS

| | | | | |
|---|---|---|---|---|
| 5,823,824 | A | | 10/1998 | Mitamura et al. |
| 5,857,867 | A | * | 1/1999 | Henry ..... 439/290 |

FOREIGN PATENT DOCUMENTS

| | | | |
|---|---|---|---|
| DE | 29 09 616 | | 9/1980 |
| EP | 000459026 | A1 * | 12/1990 |
| EP | 000477855 | A2 * | 1/1992 |
| FR | 586 049 | | 3/1925 |
| JP | 10-27641 | * | 1/1998 |
| WO | WO 00/25390 | | 5/2000 |

* cited by examiner

*Primary Examiner*—Michael C. Zarroli
(74) *Attorney, Agent, or Firm*—Nixon & Vanderhye, P.C.

(57) ABSTRACT

The invention relates to an electrical connector comprising a male contact block and a female contact block. Each of said blocks is mounted in a metallic guide (1, 2) consisting of a cylindrical proximal part (3, 4) and a distal part (5, 6) representing a cylindrical portion, both distal parts (5, 6) being of a complementary nature so as to form a cylinder when the connector is closed. The inventive electrical connector is characterised in that the proximal (3, 4) or distal (5, 6) part of one of the guides (1, 2) comprises a projecting part (7) which is housed in an opening (8) in the distal (6, 5) or proximal (4, 3) part of the other guide (2, 1).

13 Claims, 6 Drawing Sheets

MULTIPOLE ELECTRICAL CONNECTOR

This application is the US national phase of international application PCT/CH02/00117 filed Feb. 27, 2002 which designated the U.S.

BACKGROUND OF THE SUMMARY OF THE INVENTION

The present invention relates to the field of electrical connectors and in particular the field of multipole electrical connectors. It relates more specifically to an electrical connector comprising a male contact block and a female contact block, each block being mounted in a metal guide comprising at least a portion of a cylinder.

Electrical connectors of the aforementioned type are known (see, for example, the applicant company's general catalog issued in 1997). Each metal guide consist of a proximal part of cylindrical shape and of a distal part representing a portion of the cylinder, for example a semi-cylinder, the two distal parts of each block complementing each other so as to form a cylinder when the connector is connected.

The guides as described above facilitate the guidance and positioning of the male block with respect to the female block; this is particularly important in the case of multipole connectors where it is absolutely essential for each male pole to be fixed in the corresponding female pole specific to it.

The guides also act as protective elements protecting the contacts.

It is often desirable to provide a ground contact between the male and female parts of the connector. With connectors of the prior art as described above, the ground contact via the metal guides cannot be achieved because the clearance needed for them to have correct mechanical operation dictates a certain distance between the edges of the guides. This problem is particularly pronounced when the casing of the connector is made of plastic and the ground potential cannot therefore be carried by other parts.

International patent application WO 00/25390 filed by the applicant company describes a connector with a metal guide comprising at least one elastic contact element on its distal part.

Although that device makes ground connection via the metal guides possible, this type of device is relatively complicated and tricky to produce, this in particular resulting in fairly high manufacturing costs.

The present invention offers an advantageous alternative to the device described in application WO 00/25390.

It relates to an electrical connector comprising a male contact block and a female contact block, each block being mounted in a metal guide consisting of a proximal part of cylindrical shape and of a distal part representing a portion of the cylinder, the two distal parts complementing each other so as to form a cylinder when the connector is connected, said electrical connector being characterized in that the proximal or distal part of one of the guides comprises a protrusion which fits into a recess made in the distal or proximal part of the other guide.

The mechanical contact between the protrusion and the recess ensures ground contact between the two guides.

It is important to point out that mechanical contact at this point may be termed "intimate" as opposed to the mechanical contact there is between the other edges of the guides which, as was seen earlier, needs to leave clearance for correct mechanical operation of the guides.

According to a preferred embodiment of the invention, the width of the protrusion is appreciably greater than that of the recess so as to make the ground contact more effective.

According to another advantageous embodiment of the invention, the protrusion has a slot arranged along the axis of the connector. The protrusion is then made up of two tabs each of which offers a degree of elasticity greater than that of an unslotted protrusion. With such a configuration, the mechanical behavior and electromechanical durability of the system in particular are enhanced.

For the same purpose, according to another embodiment of the invention, the guide which contains the recess comprises at least two slots arranged one on each side of the recess and in the same direction as the latter.

According to another embodiment of the invention, the connector comprises several protrusions and corresponding recesses.

BRIEF DESCRIPTION OF THE DRAWINGS

A few exemplary embodiments of the invention are described hereinafter by means of the following figures.

DETAILED DESCRIPTION OF THE INVENTION AND THE EXEMPLARY EMBODIMENTS

Figure 1:
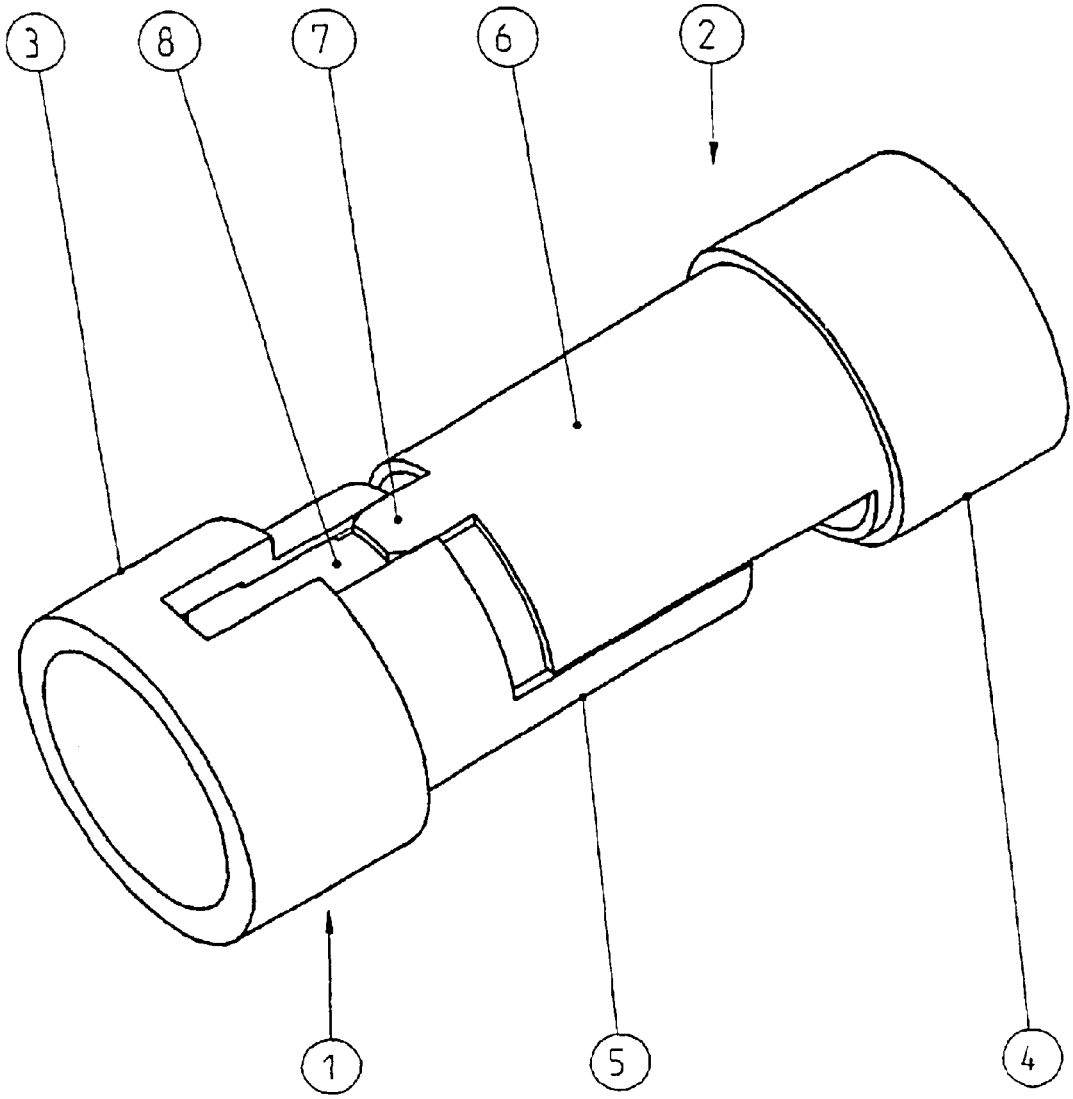
FIG. 1 depicts a first embodiment of the invention.

With a view to simplifying the description of the invention, the following figures depict only the "heart" of the invention, namely a pair of metal guides 1, 2. The casing of the connector, which casing surrounds the guides, and the male and female blocks which are placed inside the guides, are not illustrated.

Each guide 1, 2 is made up of a proximal part 3, 4 of cylindrical shape and of a distal part 5, 6 representing a semi-cylinder.

Once the connector has been connected, the distal parts 5, 6 become superimposed on one another and form a cylinder. The free end of the distal part 6 of one of the guides 2 has a protrusion 7 located mid-way between the edges of the semi-cylinder that makes up the distal part 6 and which is arranged along the main axis of the guides 1, 2.

The free end of the proximal part 3 of the other guide 1 comprises a recess 8 the shape of which is such that the protrusion 7 can be housed firmly therein. In order to improve the electrical contact at the protrusion 7 recess 8 assembly, provision may be made for the width of the protrusion 7 to be slightly greater than that of the recess 8, typically by the order of 0.1 mm.

Figure 2:
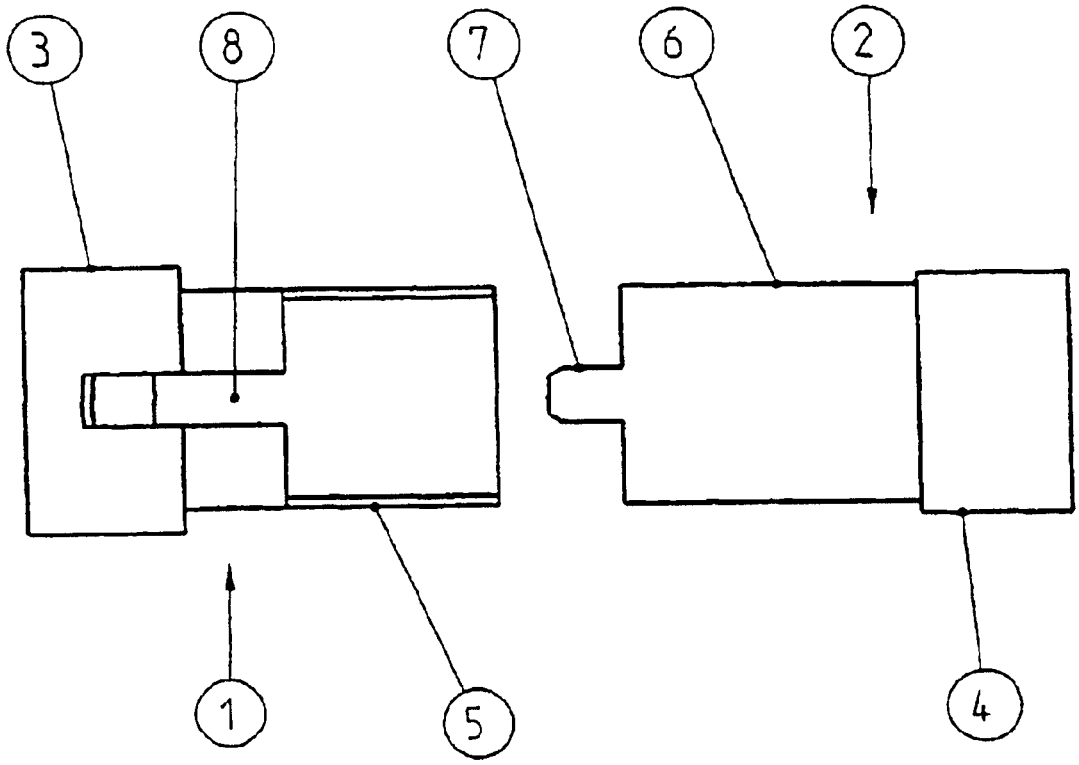
FIG. 2 depicts a view from above of the embodiment of FIG. 1.
Figure 3:
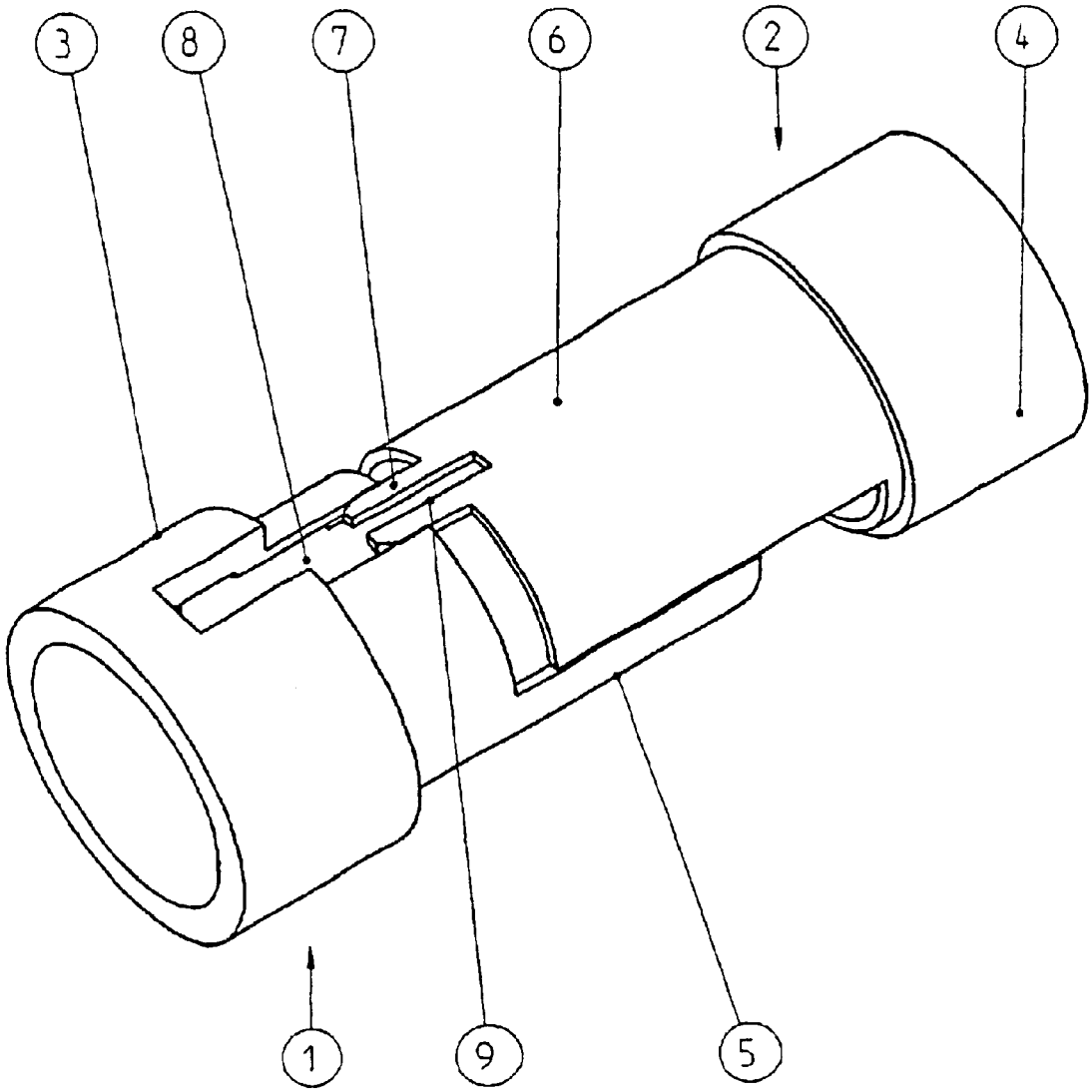
FIG. 3 depicts a second embodiment of the invention.
Figure 4:
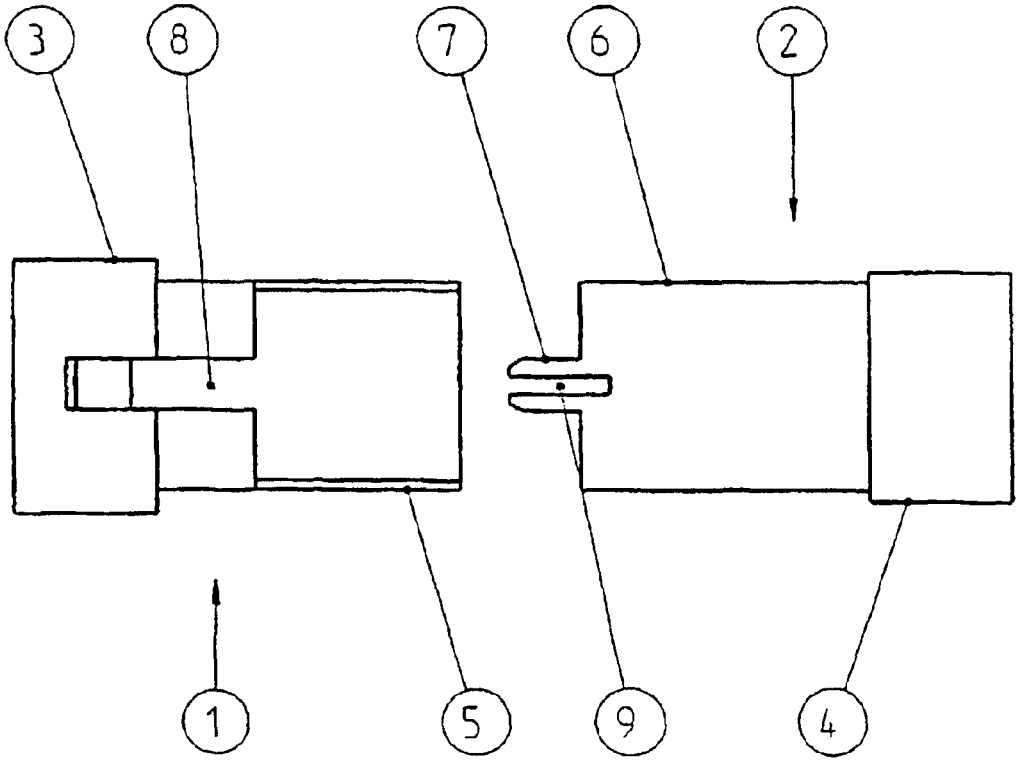
FIG. 4 depicts a view from above of the embodiment of FIG. 3.

The guides illustrated in FIGS. 3 and 4 are identical to those of FIGS. 1 and 2 except for the protrusion which has a slot 9 arranged along the main axis of the guides 1, 2. In this case the protrusion 7 does in fact consist of two tabs the elasticity of which is greater than that of the protrusion 7 illustrated in FIGS. 1 and 2. The ground contact between the guides 1, 2 essentially improves the mechanical behavior and electromechanical durability of the system.

Figure 5:
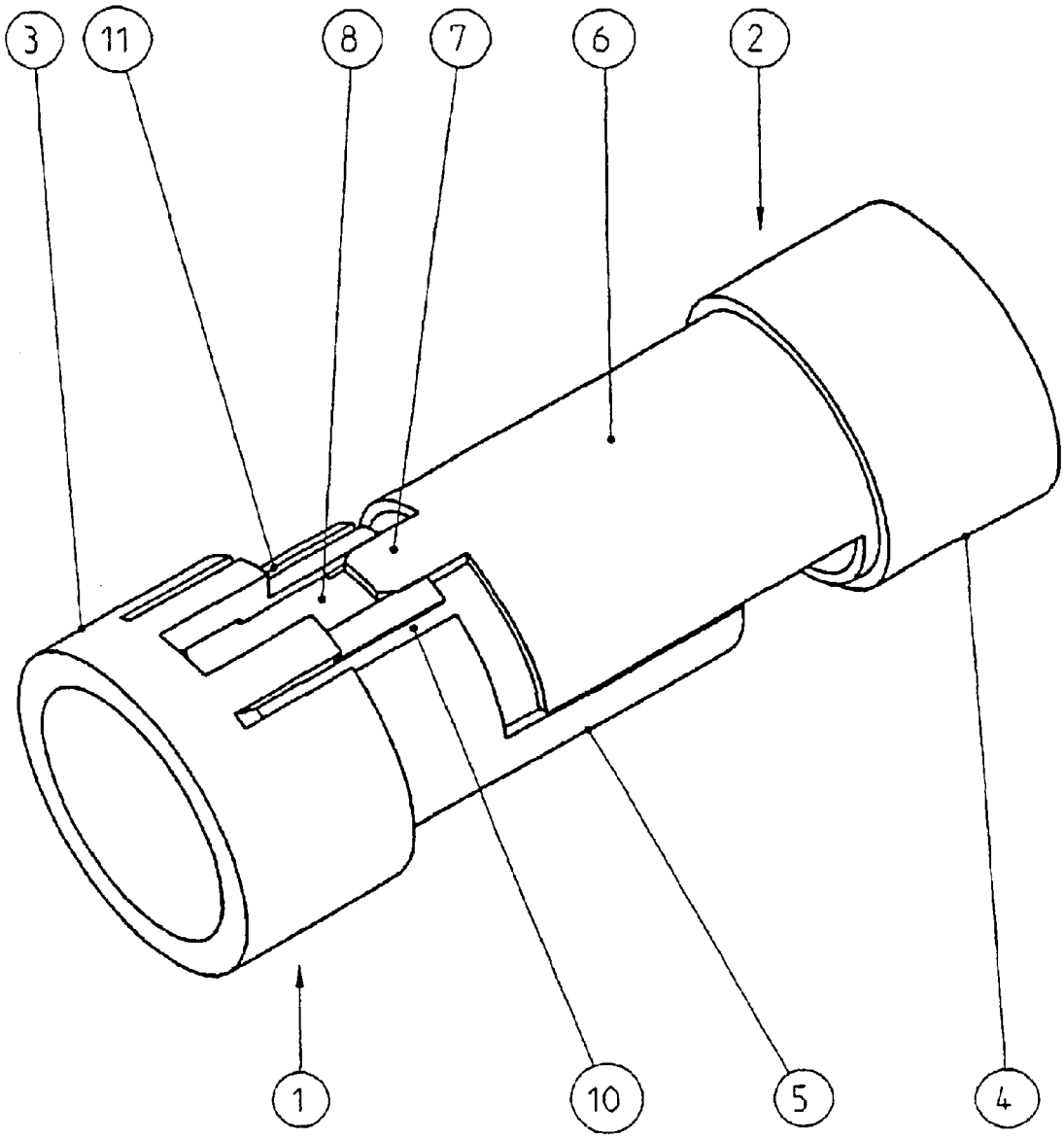
FIG. 5 depicts a first embodiment of the invention.
Figure 6:
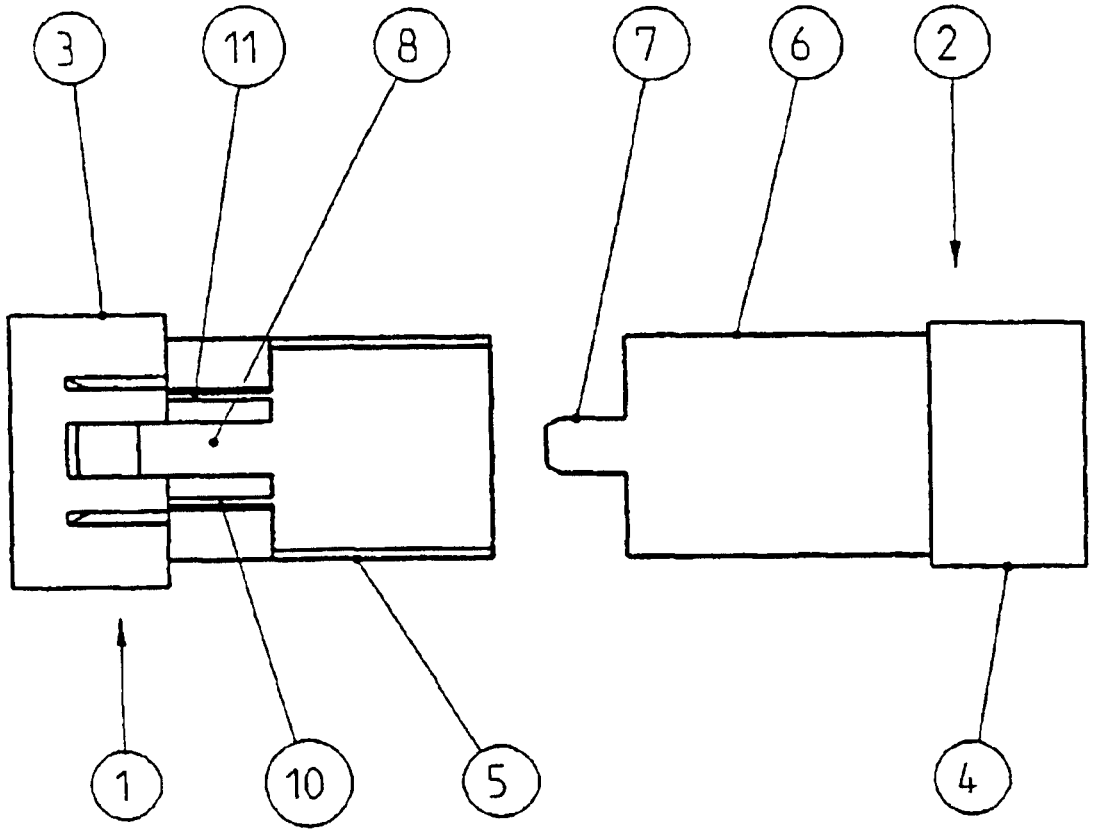
FIG. 6 depicts a view from above of the embodiment of FIG. 5.

The guides illustrated in FIGS. 5 and 6 are identical to those of FIGS. 1 and 2 except for the fact that on each side of the recess 8 there are arranged two parallel slots 10, 11. The elasticity of the edges of the recess is therefore increased, this essentially enhancing the mechanical behavior and even the electromechanical durability of the system.

It goes without saying that the invention is not restricted to the examples described hereinabove.

By way of an additional example, guides combining the characteristics of the embodiments illustrated in FIGS. 3 to 6 may be envisioned, namely a protrusion comprising one slot and two slots situated on each side of the recess.

It is also possible to place the protrusion on the free end of the proximal part of one of the guides and the recess on the free end of the distal part of the other guide.

Likewise, for a guide of semi-cylindrical shape, it is not necessary to position the protrusion midway between the edges of the semi-cylinder, it may in fact be situated anywhere, even on one of the edges of the semi-cylinder.

It will also be noted that, for a given guide, the number of protrusions may be greater than one. Of course, in such a case, the number of recesses will always be equal to or higher than that of the protrusions. Indeed, rationalization considerations may demand that the part be manufactured only with the maximum number of recesses, so that the part can be used in several scenarios.

It will finally be pointed out that the distal parts of the guides are not necessarily semi-cylindrical. It is, for example, possible to envision for one guide to have two separate quarter cylinders, each quarter cylinder comprising a protrusion or a recess.

What is claimed is:

1. An electrical connector comprising:

a male contact blocks and a female contact block, each block being mounted in a metal guide consisting of a proximal part of cylindrical shape and of a distal part representing a semi-cylinder, the two distal parts complementing each other so as to form a cylinder when the connector is connected, said electrical connector being characterized in that the proximal or distal part of one of the guides comprises a protrusion designed to fit into a recess made in the distal or proximal part of the other guide, this being so as to provide a ground contact between the two guides.

2. The connector as claimed in claim 1, characterized in that the protrusion has a slot arranged along the main axis of the guides.

3. The connector as claimed in claim 1, characterized in that the guide which contains the recess comprises at least two slots arranged one on each side of the recess and in the same direction as the recess.

4. The connector as claimed in claim 1, characterized in that it comprises several protrusions and an equal or higher number of corresponding recesses.

5. The connector as claimed in claim 1, characterized in that the width of the protrusion is appreciably greater than the width of the corresponding recess.

6. An electrical connector comprising:

a male contact block, and a female contact block, each block being mounted in a metal guide consisting of a proximal part of cylindrical shape and of a distal part representing a semi-cylinder, the two distal parts complementing each other so as to form a cylinder when the connector is connected, said electrical connector being characterized in that the proximal or distal part of one of the guides comprises a protrusion designed to fit into a recess made in the distal or proximal part of the other guide, this being so as to provide a ground contact between the two guides, and wherein the connector comprises several protrusions and an equal or higher number of corresponding recesses.

7. The connector as claimed in claim 6, characterized in that the protrusion has a slot arranged along the main axis of the guides.

8. The connector as claimed in claim 6, characterized in that the guide which contains the recess comprises at least two slots arranged one on each side of the recess and in the same direction as the recess.

9. The connector as claimed in claim 6, characterized in that the width of the protrusion is appreciably greater than the width of the corresponding recess.

10. An electrical connector comprising:

a male contact block, and a female contact block, each block being mounted in a metal guide consisting of a proximal part of cylindrical shape and of a distal part representing a semi-cylinder, the two distal parts complementing each other so as to form a cylinder when the connector is connected, said electrical connector being characterized in that the proximal or distal part of one of the guides comprises a protrusion designed to fit into a recess made in the distal or proximal part of the other guide, this being so as to provide a ground contact between the two guides, and wherein the width of the protrusion is appreciably grater than the width of the corresponding recess.

11. The connector as claimed in claim 10, characterized in that the protrusion has a slot arranged along the main axis of the guides.

12. The connector as claimed in claim 10, characterized in that the guide which contains the recess comprises at least two slots arranged one on each side of the recess and in the same direction as the recess.

13. The connector as claimed in claim 10, characterized in that it comprises several protrusions and an equal or higher number of corresponding recesses.

* * * * *